US005263993A

United States Patent [19]

Yamada

[11] Patent Number: 5,263,993

[45] Date of Patent: Nov. 23, 1993

[54] DIE CASTING MACHINE

[75] Inventor: Sadayoshi Yamada, Kanagawa, Japan

[73] Assignee: Toshiba Kikai Kabushiki Kaisha, Tokyo, Japan

[21] Appl. No.: 824,149

[22] Filed: Jan. 22, 1992

[30] Foreign Application Priority Data

Jan. 24, 1991 [JP] Japan ..... 3-24153

[51] Int. Cl.[5] ..... B22D 17/12; B22D 17/20

[52] U.S. Cl. ..... 164/312; 164/342

[58] Field of Search ..... 164/312, 342

[56] References Cited

U.S. PATENT DOCUMENTS

| | | | |
|---|---|---|---|
| 2,103,438 | 12/1937 | Schultz | 164/312 |
| 4,655,274 | 4/1987 | Dannoura | 164/342 X |
| 4,690,197 | 9/1987 | Dannoura | 164/312 |
| 4,741,379 | 5/1988 | Dannoura | 164/312 |

FOREIGN PATENT DOCUMENTS

| | | | |
|---|---|---|---|
| 61-286050 | 12/1986 | Japan | 164/312 |
| 62-34655 | 2/1987 | Japan | 164/342 |
| 2-274357 | 11/1990 | Japan | 164/342 |

*Primary Examiner*—J. Reed Batten, Jr.

*Attorney, Agent, or Firm*—Stevens, Davis, Miller & Mosher

[57] ABSTRACT

A die casting machine is provided with a mold, which comprises stationary and movable mold halves between which a mold cavity is formed and which is clamped by a horizontal clamping force and a molten bath is injected vertically, and the die casting machine comprises an injection sleeve secured to parting surface portions of the stationary and movable mold halves, an injection plunger device disposed below the injection sleeve concentrically therewith for injecting the molten bath into the injection sleeve and press-feeding the molten bath into the mold cavity, and connecting tie rods operatively connecting the injection plunger device to the mold halves. The connecting tie rods each has one end engaged with the parting surface portions of the stationary and movable mold halves so as to suspend the injection plunger device by the stationary and movable mold halves. The tie rods are disposed on the same plane as the location of the parting surface portions of the mold halves symmetrically with respect to a center line of the injection sleeve. The tie rods each have one end formed as an engaging portion having bilaterally expanded portions so as to exhibit substantially T-shaped expanded portions in longitudinal section and the expanded portions are engaged with grooves formed to the parting surface portions of the stationary and movable mold halves.

18 Claims, 9 Drawing Sheets

DIE CASTING MACHINE

BACKGROUND OF THE INVENTION

The present invention relates to a die casting machine and more particularly to a die casting machine having an improved structure in which a mold is clamped by a horizontal clamping force, a molten bath is injected vertically, and injection pressure is not adversely applied to constructional members.

Recently, an aluminum alloy die cast product has been widely utilized for strong structural parts or elements. In a die casting method for producing such an aluminum alloy die cast product with substantially no cavity, a vertical injection-type die casting machine has been utilized for the reason that a vertical injection-type die casting machine has a relatively short injection sleeve and hence has a merit of less temperature lowering of a molten bath during the injection process. Moreover, there is no fear of causing cavities due to gas in the injection sleeve, and since an injection plunger faces a cavity of a mold assembly, an injection pressure is effectively transferred. According to these advantageous points, the vertical injection-type die casting machine has been widely utilized, and more particularly, since a horizontal clamping-type machine, in which the mold is clamped by horizontal clamping force, has a good maneuverability, a horizontal clamping- and vertical injection-type die casting machine has been widely utilized.

FIG. 9 shows one example of a conventional horizontal clamping- and vertical injection-type die casting machine, which is for example disclosed in the Japanese Utility Model Publication No. 2-21168. Referring to FIG. 9, a mold assembly comprises a stationary mold half 100 and a movable mold half 101, which are horizontally clamped by the horizontal clamping- and vertical injection-type die casting machine which is equipped with an injection plunger 103 for injecting a molten bath into a cavity 102. The injection plunger 103 is accommodated in a pit 104 formed by digging in an installation bed and is swingable through a swing shaft 105. A molten bath feed gate 115 is formed to the parting surfaces of the stationary and movable mold halves 100 and 101. In each injection cycle, the injection plunger 103 is swung to feed the molten bath from a ladle to an injection sleeve 106, and the injection sleeve 106 is positionally aligned with the gate 115 and abuts thereagainst under pressure, whereby the molten bath is injected into the cavity 102 of the mold assembly.

In the horizontal clamping- and vertical injection-type die casting machine of the structure described above, since the injection pressure is applied in a direction normal to a direction of a clamping force, the stationary and movable mold halves 100 and 101 are pressed upwardly as shown in FIG. 10 and a tie bar 107 is bent, and hence the upper portions of the stationary and movable mold halves 100 and 101 are opened, resulting in a generation of burr in a mold product.

In order to obviate such defect, in the prior art, as shown in FIG. 9, a lower portion of a stationary die plate 108 is secured to a machine frame 109, and a movable die plate 110, under the mold clamped state, is provided with a securing member 111 for securing it to the machine frame 109. The movable die plate 110 is supported by the machine frame 109 so as to prevent the movable die plate 110 from being raised and bent by the injection pressure.

However, even in this improved prior art structure, it is necessary to locate the securing member 111 for securing the movable die plate 110 at the time of clamping the mold, complicating the structure for withstanding the injection pressure. Moreover, it is necessary to dig the pit 104 into the installation bed for locating the injection plunger, which makes maneuverbility and maintenance of the die casting machine itself difficult.

Furthermore, in order to solve the prior art problem described above, the same applicant provided a further improved die casting machine such as disclosed in the U.S. patent application Ser. No. 1-93349 (93349/1989) and shown in FIG. 11. Referring to FIG. 11, a die casting machine is provided with an injection plunger 203 which is secured to a injection frame 212. The injection frame 212 is inserted, to be slidable, into a guide groove 213 formed in parallel with a mold opening-closing direction at a position below stationary and movable die plates 208 and 210 so that the injection frame 212 is suspended in the groove 213. In this prior art structure, the injection pressure is received uniformly by the stationary and movable die plates 208 and 210 so as not to apply the bending moment to stationary and movable mold halves 200 and 201.

However, in the prior art structure of FIG. 11, since the injection plunger 203 is coupled to the stationary die plate 208 and the movable die plate 210 through the injection frame 212, it is necessary to perform a centering adjustment of the injection plunger 203 with respect to an injection sleeve 206 provided on parting surfaces of the stationary and movable mold halves 200 and 201 secured to the respective die plates 208 and 210. Namely, because it is required to selectively use the stationary and movable mold halves 200 and 201 having different thicknesses in accordance with differing kinds of cast products, a centering adjustment is needed between the injection plunger 203 and the injection sleeve 206 to be fitted to the parting surfaces of the mold halves 200 and 201 every time of the exchanging of the mold halves. Therefore, the construction of the die casting machine itself becomes complicated and the centering adjustment involves much time and troublesome work, thus being inconvenient even in this improved structure of the die casting machine.

SUMMARY OF THE INVENTION

An object of the present invention is to substantially eliminate the defects or drawbacks encountered in the prior art and to provide a horizontal clamping- and vertical injection-type die casting machine in which an injection plunger device is directly suspended by a mold so as to prevent injection pressure from being applied to other constructional elements or parts.

Another object of the present invention is to provide a die casting machine that does not require a centering adjustment of the injection sleeve and the injection plunger device even in the mold exchanging time with simple structure.

These and other objects can be achieved according to the present invention by providing a die casting machine in which a mold, which comprises stationary and movable mold halves between which a mold cavity is formed, is clamped by a horizontal clamping force and a molten bath is injected vertically, the die casting machine comprising an injection sleeve secured to parting surface portions of the stationary and movable mold halves, an injection plunger device disposed below the injection sleeve for injecting the molten bath into the injection sleeve and press-feeding the molten bath into the mold cavity, and a connecting member operatively connecting the injection plunger device to the mold, the connecting member having one end engaged with the parting surface portions of the stationary and movable mold halves so as to suspend the injection plunger device by the stationary and movable mold halves.

In the preferred embodiment, the injection plunger device is disposed concentrically with the injection sleeve mounted to the parting surface portions of the stationary and movable mold halves. The connecting member comprises a pair of tie rods each having one end engaged with the parting surface portions of the stationary and movable mold halves, and the tie rods are disposed on the same plane as the location of the parting surface portions of the stationary and movable mold halves symmetrically with respect to a center line of the injection sleeve. The tie rods each have one end formed as an engaging portion having bilaterally expanded portions in longitudinal section so as to exhibit substantially T-shaped expanded portions, and the expanded portions are engaged with grooves formed to the parting surface portions of the stationary and movable mold halves.

The injection plunger device comprises a injection cylinder including a piston rod and an injection plunger having one end connected to the piston rod and another end fitted into the injection sleeve.

According to the die casting machine of the structure described above, the injection plunger device is integrally connected to the mold comprising stationary and movable mold halves through the connection tie rods, so that the injection pressure is borne by the injection plunger device and the mold halves, and hence, is not applied to other members such as tie bar, stationary and movable die plates and base frame, so that the mold is not opened by the injection pressure force.

Furthermore, the injection plunger device is directly connected to the stationary and movable mold halves, so that the centering adjustment between the injection plunger device and the injection sleeve is not needed in a case where the mold is exchanged with new one having a thickness different from that of the former one, thus resulting in the simplified structure of the die casting machine itself and having improved maneuverability.

DESCRIPTION OF THE PREFERRED EMBODIMENT

Figure 1:
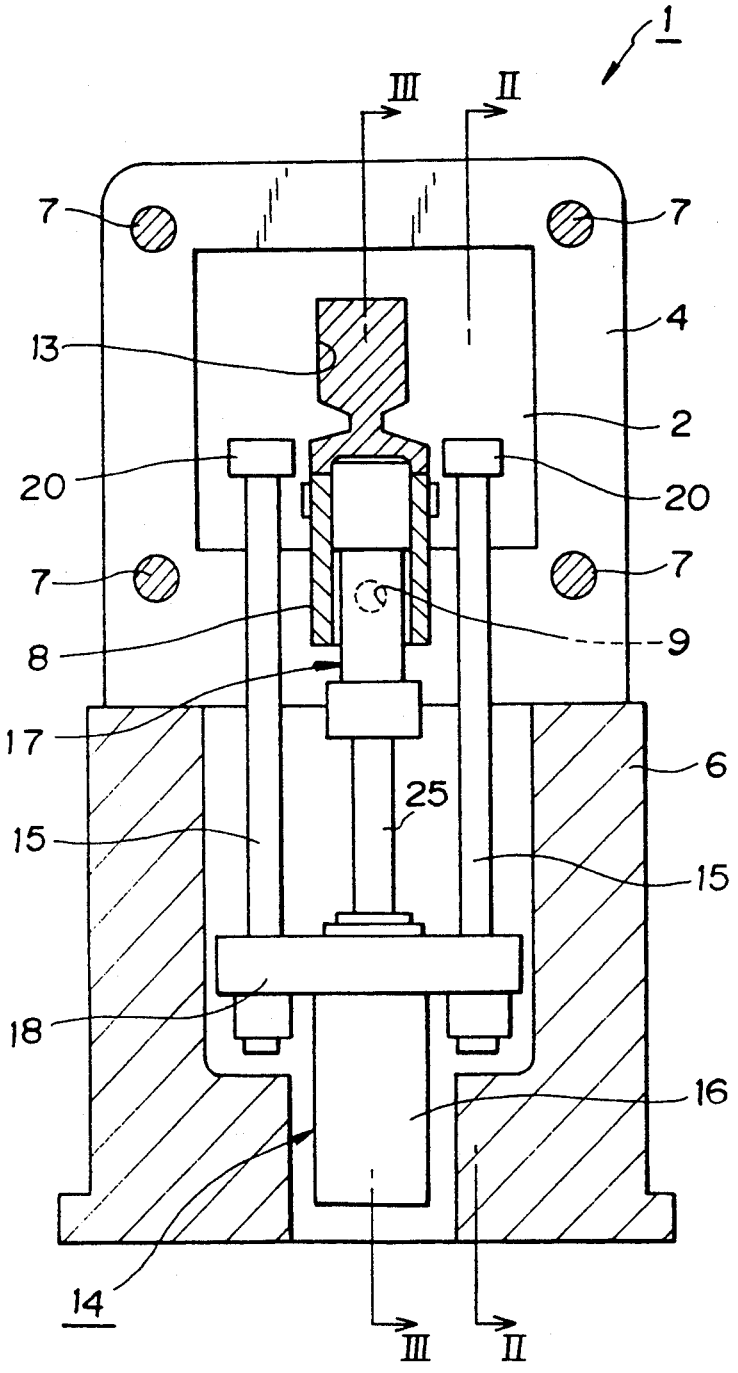
FIG. 1 shows an elevational section of a horizontal clamping- and vertical injection-type die casting machine according to the present invention, taken along parting surface portions of mold halves thereof.

Referring to FIGS. 1 to 4 showing a die casting machine of the type in which a mold is clamped by horizontal force and injection is carried out vertically, called herein a horizontal clamping- and vertical injection-type die casting machine, a die casting machine 1 includes a mold or mold assembly comprising stationary mold half 2 and a movable mold half 3 which are clamped by the horizontal clamping force. The stationary mold half 2 is secured to a stationary die plate 4 and the movable mold half 3 is secured to a movable die plate 5. The stationary die plate 4 is mounted at its lower portion to a machine frame 6 and the movable die plate 5 is moved through a guidance of a tie bar 7 to thereby carry out the mold opening-closing operation.

Figure 3:
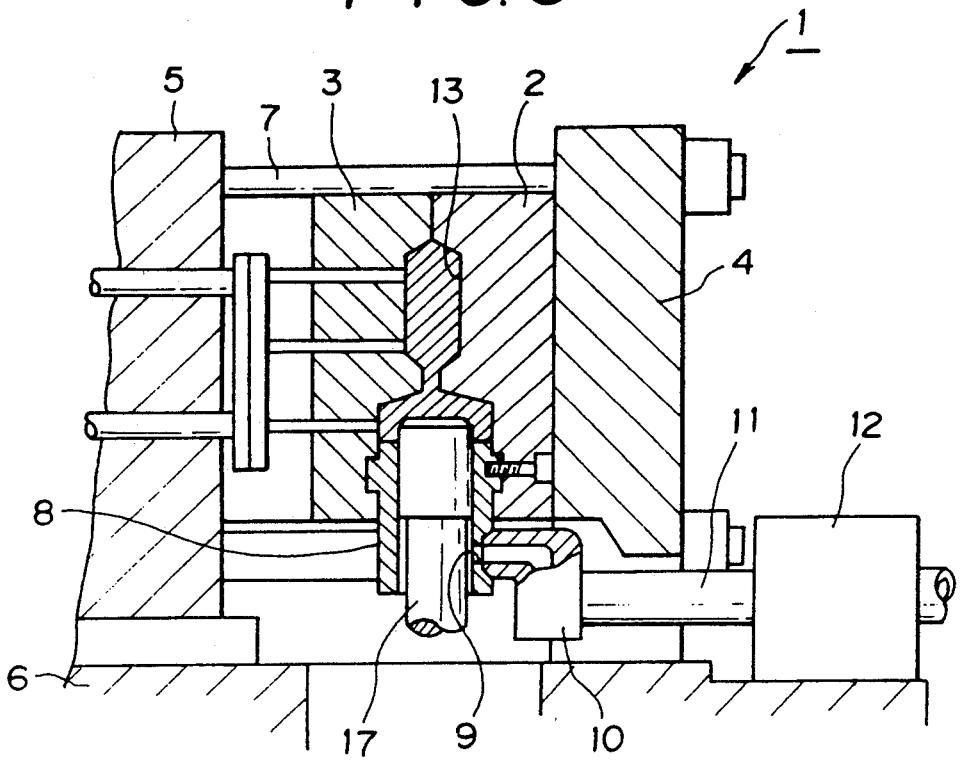
FIG. 3 is a sectional view taken along the line III—III of FIG. 1.
Figure 8:
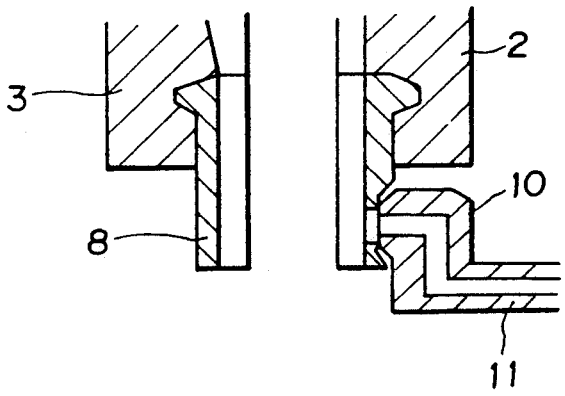
FIG. 8 shows a state in which a splittable-type injection sleeve is opened.
Figure 9:
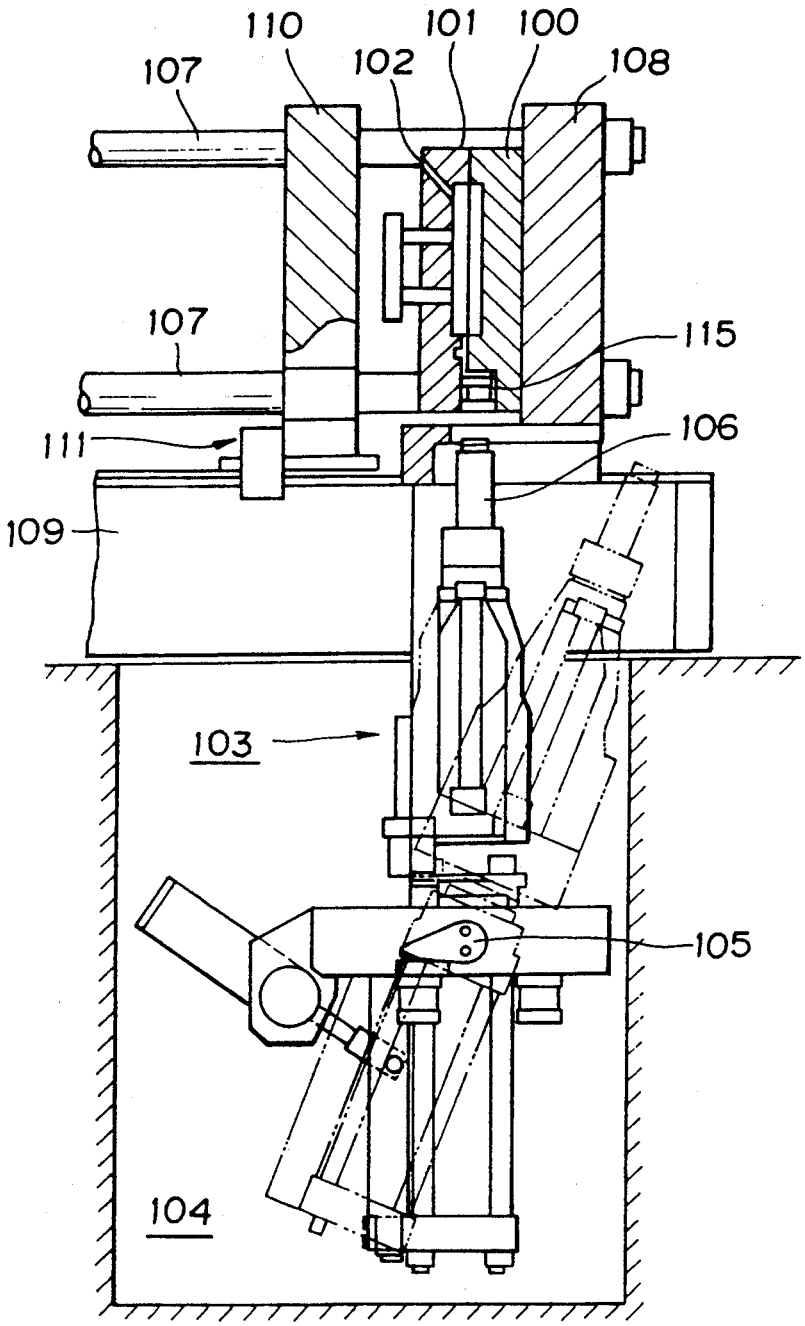
FIG. 9 PRIOR ART
FIG. 9 is a partial sectional view of a horizontal clamping- and vertical injection-type die casting machine of prior art structure.
Figure 10:
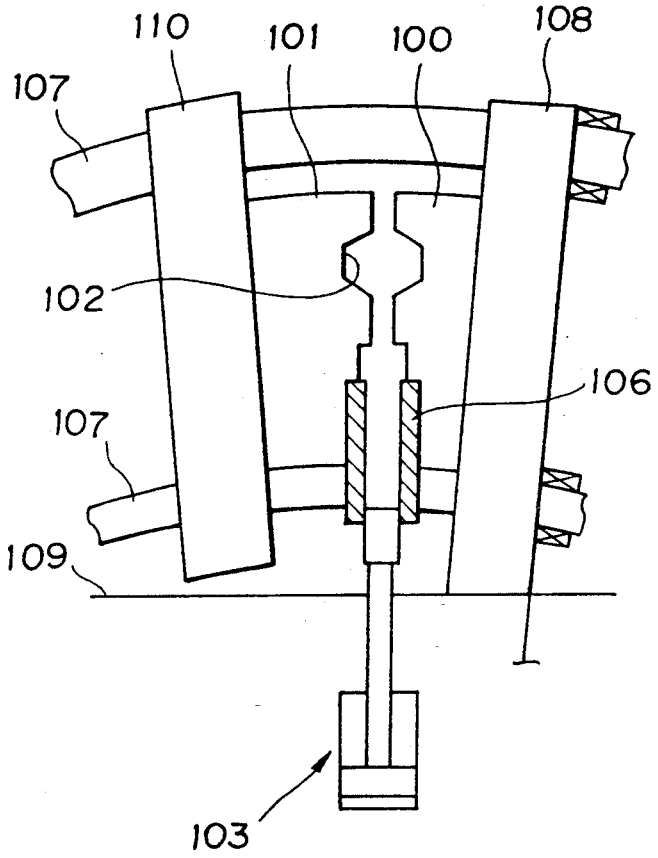
FIG. 10 PRIOR ART
FIG. 10 is a partial view of FIG. 9 for the explanation of a problem of the conventibnal structure.
Figure 11:
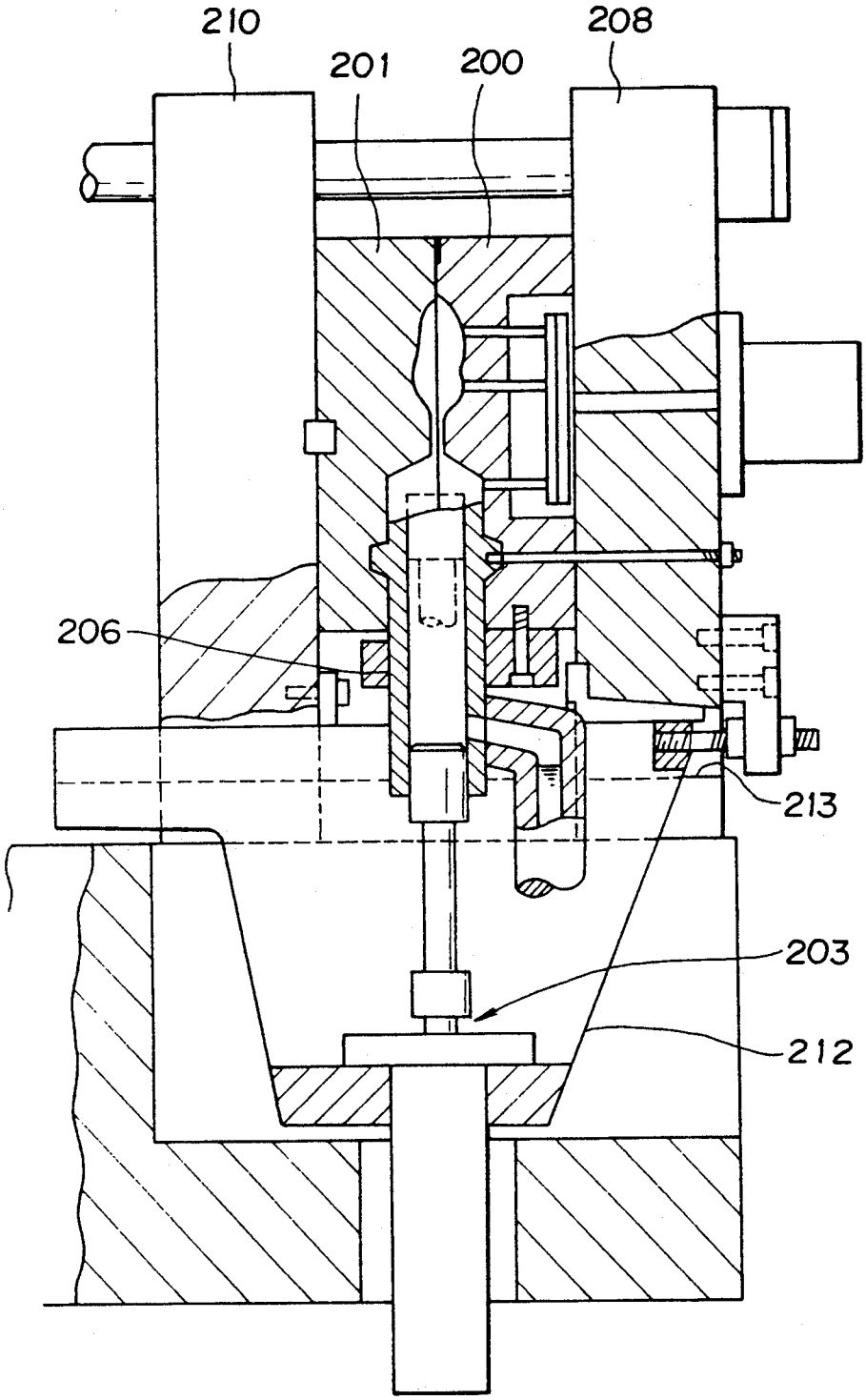
FIG. 11 PRIOR ART
FIG. 11 is also a partial sectional view of another horizontal clamping- and vertical injection-type die casting machine of the conventional structure.

To splittable mating surface portions, i.e. parting surface portions, of the stationary and movable mold halves 2 and 3 is secured one end of an injection sleeve 8, which has another end projecting downwardly. The injection sleeve 8 may be constructed as an integrated single body which is secured to the stationary mold half 2 or as a body splittable, into two parts, one part being secured to the stationary mold half 2 and another part being secured to the movable mold half 3 as shown in FIG. 8. A molten bath feed gate 9 is formed to a side surface of the injection sleeve 8, and to the feed gate 9 is connected a mouth piece 10 to which a molten bath feed pipe 11 is connected. The molten bath is directly fed into the injection sleeve 8 through the mouth piece 10 and the feed pipe 11 by the actuation of an electromagnetic pump 12 as shown in FIG. 3. The molten bath feeding method utilizing the electromagnetic pump 12 may be substituted with another direct feed means utilizing such as a pneumatic pressure, a plunger or a vacuum suction. Furthermore, a molten bath feed method utilizing a ladle may be adapted.

The die casting machine 1 is further provided with an injection plunger device 14 for injecting the molten bath fed into the injection sleeve 8 into a mold cavity 13 defined between the stationary and movable mold halves 2 and 3. The injection plunger device 14 is suspended by the stationary and movable mold halves 2 and 3 through a pair of tie rods 15, 15 as connecting members which are secured to the parting surface portions of the mold halves 2 and 3 in a manner concentric with the injection sleeve 8 which is fitted to the parting surface portions. The paired tie rods 15, 15 are disposed on the same plane as the location of the parting surface portions of the mold halves 2 and 3 and are arranged in symmetry with each other with respect to the center line of the injection sleeve 8.

The injection plunger device 14 comprises an injection cylinder 16 provided with a piston rod 25 and an injection plunger 17 which is reciprocally moved by the operation of the injection cylinder 16. A plate member 18 is secured to one end, on the side of the injection sleeve 8, of the injection cylinder 16, and the stationary and movable mold halves 2 and 3 are operatively connected to the plate member 18 through the tie rods 15, 15, respectively. The tie rods 15, 15 have lower ends, as viewed in FIG. 5, for example, as flanged portions which are firmly fastened to the plate member 18 by means of screw bolts 19, 19. The tie rods 15, 15 are also secured, at their upper portions, to the stationary mold half 2 by means of screw bolts 29 so as not to fall down when the mold is opened. In the present embodiment, each of the upper ends of the tie rods 15, 15 is formed as engaging portion 20 having bilaterally expanded portions 21 having a T-shape in the longitudinal section. The engaging portion 20 is engaged with the stationary and movable mold halves 2 and 3, and namely, the expanded portions 21, 21 are engaged with grooves 22, 22 formed to the parting surface portions of the stationary and movable mold halves 2 and 3. The expanded portions 21, 21 are bilaterally symmetric with each other in the direction normal to the parting surface portions of the mold halves 2 and 3 and have the same expanded sizes in the bilateral direction.

Figure 2:
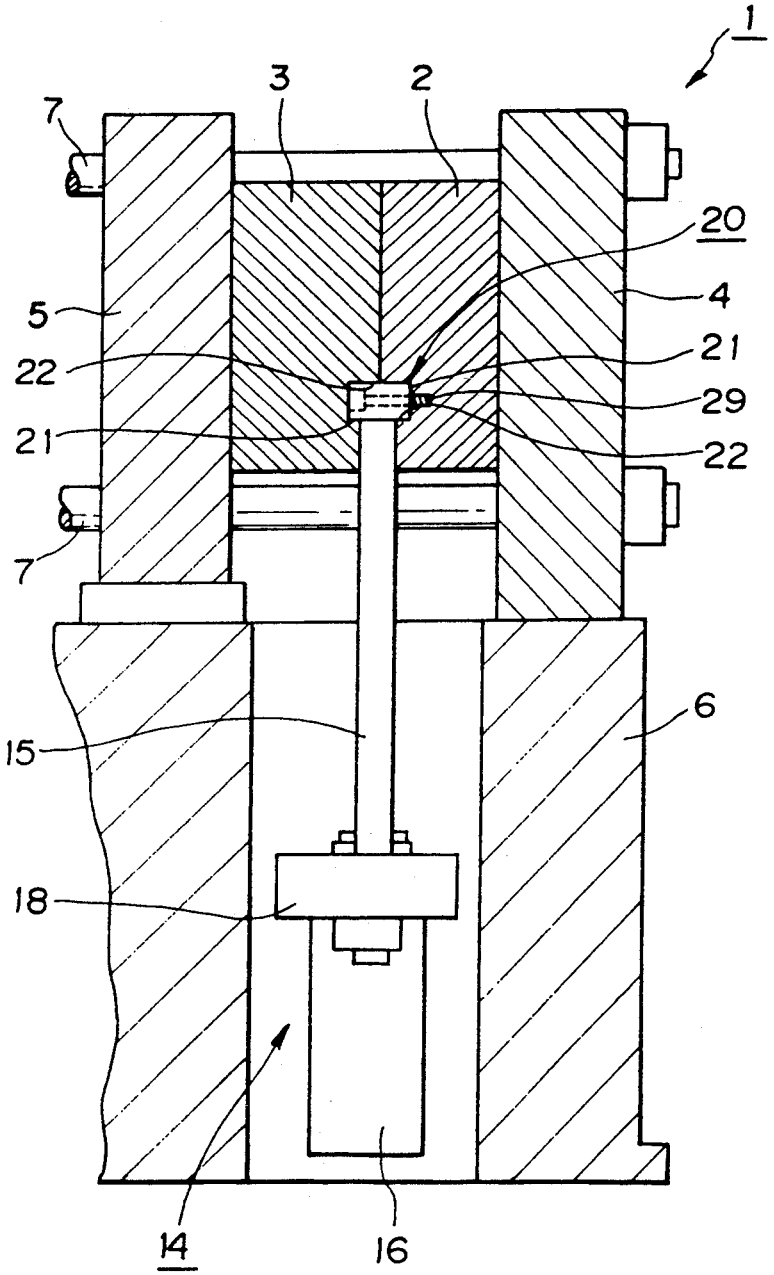
FIG. 2 is a sectional view taken along the line II—II of FIG. 1.
Figure 4:
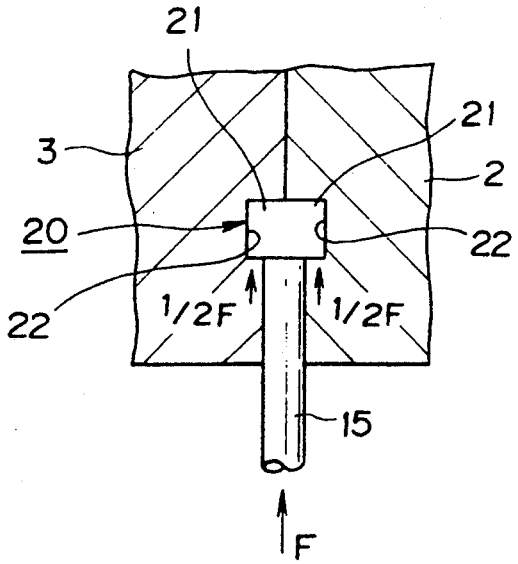
FIG. 4 is partial sectional view showing a tie rod of FIG. 2 for the explanation of an injection pressure.
Figure 5:
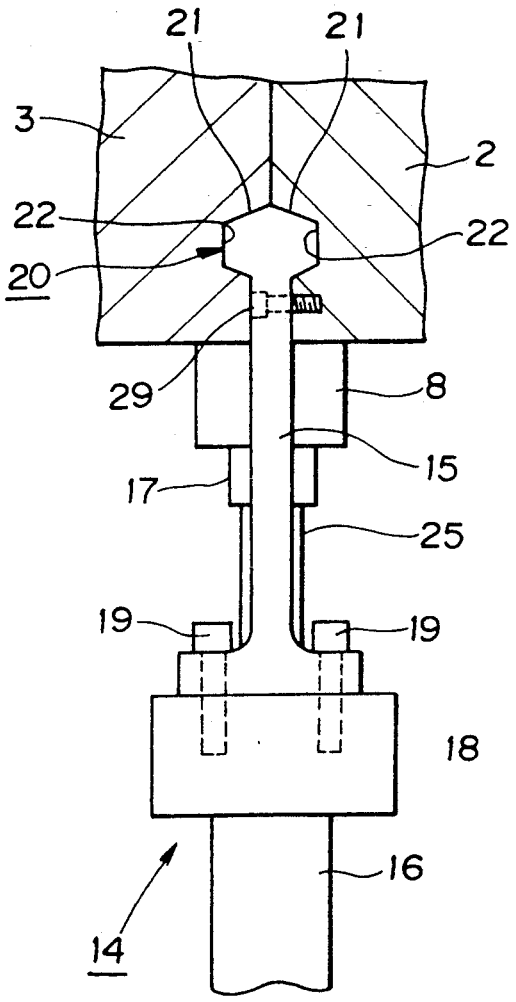
FIG. 5 is a view similar to FIG. 4, but shows another example.
Figure 6:
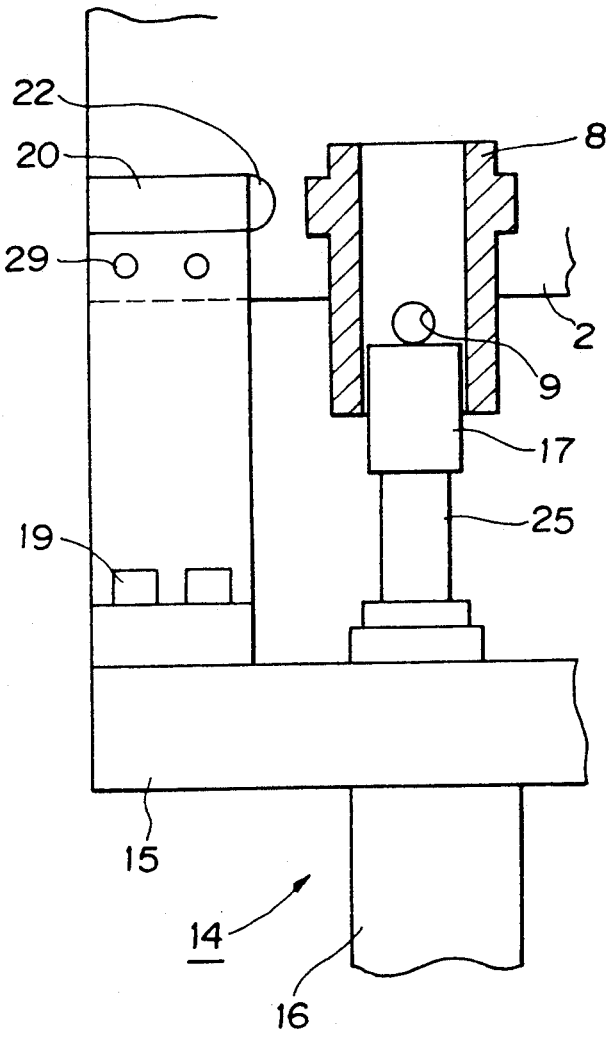
FIG. 6 is a partial front view of the tie rod.
Figure 7:
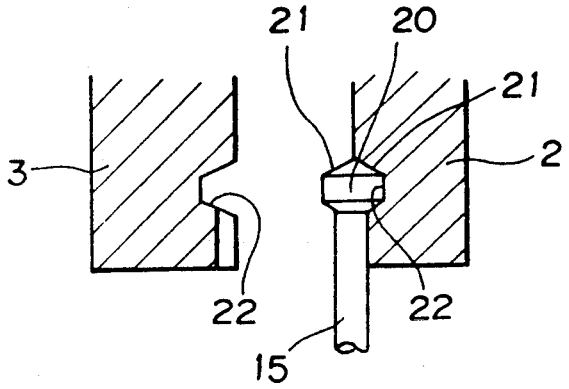
FIG. 7 shows a state in which mold halves are opened with the tie rod of FIG. 5 being utilized.

The engaging portion 20 may be formed so as to have a rectangular shape in its longitudinal section as shown in FIG. 2 or 4, or have a tapered shape in its longitudinal section as shown in FIG. 5 or 7. In the case of the tapered shape, the expanded portions 21, 21 of the engaging portion 20 can be smoothly engaged with the grooves 22, 22, respectively, when the mold is closed.

The injection plunger 17 is fitted at its upper end to the injection sleeve 8 and secured at its other end to the piston rod 25 of the injection cylinder 16, which is actuated vertically as viewed in FIG. 2, for example, by a hydraulic or other actuating means, whereby the injection plunger device 14 is vertically driven and the molten bath is fed into the cavity 13.

In the horizontal clamping- and vertical injection-type die casting machine of the structure described above, the tie rods 15, 15 are supported by the stationary and movable mold halves 2 and 3, respectively, at the mold clamping time, whereas the tie rods are supported by the stationary mold half 2 at the mold opening time.

According to the described embodiment, the stationary and movable mold halves 2 and 3 are operatively integrally connected to the injection plunger device 14 through the tie rods 15, 15, so that the injection force F, in FIG. 4, is borne by the injection plunger device 14 and the mold halves 2 and 3, and hence, the injection force F is uniformly borne by the stationary and movable mold halves 2 and 3 by F/2, respectively. Thus, since the injection force F is not applied to the tie bar 7, the stationary and movable die plates 4 and 5, the machine frame 6 and other members, the stationary and movable mold halves 2 and 3 cannot be adversely opened by the injection force.

Moreover, since the stationary and movable mold halves 2 and 3 are directly connected to the injection plunger device 14, the centering adjustment between the injection plunger 8 and these mold halves 2, 3 and the injection plunger device 14 is not needed even if the stationary and movable mold halves 2 and 3 are exchanged with new ones having thicknesses different from those of the former ones. Accordingly, the structure of the die casting machine can be simplified, and hence, the maneuverability is highly improved.

It is to be understood that the present invention is not limited to the described preferred embodiment and many other changes and modifications may be made without departing from the scope of the appended claims.

What is claimed is:

1. A die casting machine in which a mold, which comprises stationary and movable mold halves between which a mold cavity is formed, is held together by a horizontal holding force, whereby the stationary and movable mold halves are held together so that a mating surface of the stationary mold half mates with a mating surface of the movable mold half, and in which a molten bath is injected vertically, the die casting machine comprising:

an injection sleeve secured to the mating surfaces of the stationary and movable mold halves;

an injection plunger device disposed below the injection sleeve for injecting the molten bath into the injection sleeve and pressing the molten bath into the mold cavity; and connecting means for operatively connecting the injection plunger device to the mold, said connecting means having one end engaged with the mating surfaces of the stationary and movable mold halves so as to suspend the injection plunger device by the stationary and movable mold halves.

2. A die casting machine according to claim 1, wherein said injection plunger device is disposed concentrically with the injection sleeve.

3. A die casting machine according to claim 1, wherein said connecting means comprises a pair of tie rods each having one end engaged with the mating surfaces of the stationary and movable mold halves, and wherein said tie rods are disposed to be coplanar with the mating surfaces of the stationary and movable mold halves symmetrically with respect to a center line of the injection sleeve.

4. A die casting machine according to claim 3, wherein each of said tie rods has one end formed as an engaging portion having bilaterally expanded portions so as to exhibit substantially T-shaped expanded portions in longitudinal section and the expanded portions are engaged with grooves formed to the mating surfaces of the stationary and movable mold halves.

5. A die casting machine according to claim 4, wherein the engaging portion has a substantially rectangular longitudinal section.

6. A die casting machine according to claim 4, wherein the engaging portion has a tapered longitudinal section in a bilateral direction thereof.

7. A die casting machine according to claim 1, wherein said injection plunger device comprises an injection cylinder including a piston rod and an injection plunger having one end connected to the piston rod and another end fitted into the injection sleeve.

8. A die casting machine according to claim 1, wherein the injection sleeve comprises two separable components.

9. A die casting machine according to claim 8, wherein one of the two separable components of the injection sleeve is secured to the stationary mold half and wherein the other of the two separable components of the injection sleeve is secured to the movable mold half.

10. A die casting machine in which a mold, which comprises stationary and movable mold halves between which a mold cavity is formed, is held together by a horizontal holding force, whereby the stationary and movable mold halves are held together so that a mating surface of the stationary mold half mates with a mating surface of the movable mold half, and in which a molten bath is injected vertically, the die casting machine comprising:

an injection sleeve secured to the mating surface of the stationary mold half;

an injection plunger device disposed below the injection sleeve for injecting the molten bath into the injection sleeve and pressing the molten bath into the mold cavity; and connecting means for operatively connecting the injection plunger device to the mold, said connecting means having one end engaged with the mating surfaces of the stationary and movable mold halves so as to suspend the injection plunger device by the stationary and movable mold halves.

11. A die casting machine according to claim 10, wherein said injection plunger device is disposed concentrically with the injection sleeve.

12. A die casting machine according to claim 10, wherein said connecting means comprises a pair of tie rods each having one end engaged with the mating surfaces of the stationary and movable mold halves, and wherein said tie rods are disposed to be coplanar with the mating surfaces of the stationary and movable mold halves symmetrically with respect to a center line of the injection sleeve.

13. A die casting machine according to claim 12, wherein each of said tie rods has one end formed as an engaging portion having bilaterally expanded portions so as to exhibit substantially T-shaped expanded portions in longitudinal section and the expanded portions are engaged with grooves formed to the mating surfaces of the stationary and movable mold halves.

14. A die casting machine according to claim 13, wherein the engaging portion has a substantially rectangular longitudinal section.

15. A die casting machine according to claim 13, wherein the engaging portion has a tapered longitudinal section in bilateral direction thereof.

16. A die casting machine according to claim 10, wherein said injection plunger device comprises an injection cylinder including a piston rod and an injection plunger having one end connected to the piston rod and another end fitted into the injection sleeve.

17. A die casting machine according to claim 10, wherein the injection sleeve is formed as an integrated single body.

18. A die casting machine according to claim 10, further comprising first screw means for securing the connecting means to the mating surface of the stationary mold half and second screw means for securing the connecting means to the injection plunger device.

* * * * *